United States Patent [19]

Ranghelli et al.

[11] Patent Number: 4,521,754

[45] Date of Patent: Jun. 4, 1985

[54] TUNING AND TEMPERATURE COMPENSATION ARRANGEMENT FOR MICROWAVE RESONATORS

[75] Inventors: Joseph C. Ranghelli, Brooklyn, N.Y.; Joseph A. La Bella, Nutley, N.J.

[73] Assignee: International Telephone and Telegraph Corporation, New York, N.Y.

[21] Appl. No.: 527,627

[22] Filed: Aug. 29, 1983

[51] Int. Cl.[3] ..... H01P 7/04

[52] U.S. Cl. ..... 333/224; 333/207; 333/226; 333/234

[58] Field of Search ..... 333/202–212, 333/222–224, 226, 234, 235, 245, 248, 263

[56] References Cited

U.S. PATENT DOCUMENTS

| | | | |
|---|---|---|---|
| 2,103,515 | 12/1937 | Conklin et al. | 333/234 |
| 2,205,851 | 6/1940 | Hansell | 333/234 X |
| 3,748,604 | 7/1973 | Wang | 333/208 X |

OTHER PUBLICATIONS

"Sperry-Cast Precision Sandcasting as Applied to Microwave Components", Sperry Gyroscope Company, Division of Sperry Rand Corporation, Great Neck, N.Y., Pub. No. 10-106 IM 3-56, Received U.S. Patent Office Apr. 4, 1965; 8 Pages.

*Primary Examiner*—Marvin L. Nussbaum

*Attorney, Agent, or Firm*—John T. O'Halloran; Jeffrey P. Morris

[57] ABSTRACT

The microwave resonator includes an enclosed resonator housing and a hollow central conductor having one end fastened to a bottom of the resonator housing and extending toward a top wall of the resonator housing. The other end of the central conductors is spaced from the top wall and includes an adjustable bellows assembly disposed coaxial of a longitudinal axis of the central conductor. A non-rotating, axially movable drive shaft is disposed coaxial of the axis of the central conductor within the central conductor. One end of the drive shaft is fastened to the bellows assembly and the other end of the drive shaft is coupled to a drive means disposed in the bottom wall to cause axial movement of the drive shaft to adjust the axial length of the bellows assembly and, hence, the axial length of the central conductor to adjust the resonant frequency of the microwave resonator. By selecting the material from which the housing and the central conductor is made to have a first selected coefficient of thermal expansion and by selecting the material the drive shaft is made from to have a second selected coefficient of thermal expansion. The first and second coefficients of thermal expansion are selected to minimize resonant frequency drift due to temperature variations and, hence, provides temperature compensation for the microwave resonator.

31 Claims, 4 Drawing Figures

TUNING AND TEMPERATURE COMPENSATION ARRANGEMENT FOR MICROWAVE RESONATORS

BACKGROUND OF THE INVENTION

The present invention relates to microwave resonators and filters and, more particularly, to coaxial quarter wave microwave filters employing a microwave cavity resonator.

Coaxial microwave quarter wave filters in the past have used tuning screws or choke joints to provide resonant frequency tuning. The prior art quarter wave filters have a low unloaded Q which increases insertion loss, have reduced power handling and multipacting capabilities, spurious resonances and mechanical complexity with large size and weight.

SUMMARY OF THE INVENTION

An object of the present invention is to provide a microwave cavity resonator which has control for precise frequency alignment and prevention of frequency shifting due to temperature variations.

A feature of the present invention is the provision of a microwave resonator having an adjustable resonant frequency comprising an enclosed resonator housing; a hollow central conductor having one end fastened to a bottom wall of the housing and extending toward a top wall of the housing, the other end of the central conductor being spaced from the top wall and including an adjustable bellows assembly disposed coaxial of a longitudinal axis of the central conductor; and a non-rotating, axially movable drive shaft disposed coaxial of the axis within the central conductor, one end of the drive shaft being fastened to the bellows assembly and the other end of the drive shaft being coupled to a drive means disposed in the bottom wall to cause axial movement of the drive shaft to adjust the axial length of the bellows assembly and, hence, the axial length of the central conductor to adjust the resonant frequency.

Another feature of the present invention is that the housing and the central conductor are made from a material having a first selected coefficient of thermal expansion, such as aluminum, and that the drive shaft is made from a material having a second selected coefficient of thermal expansion, such as invar. The selection of the first and second coefficients of thermal expansion is such that the resonant frequency drift due to temperature variations is minimized.

The advantages of the microwave resonator in accordance with the principles of the present invention is the preservation of the cavity shape by use of an integrated bellows, as compared to the prior art arrangements using tuning screws and choke joints, having a higher unloaded Q which decreases insertion loss, having greater power handling and multipacting capability, eliminating spurious resonances and having mechanical simplicity with reduced size and weight, and having a thermal stability which reduces resonant frequency drift.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
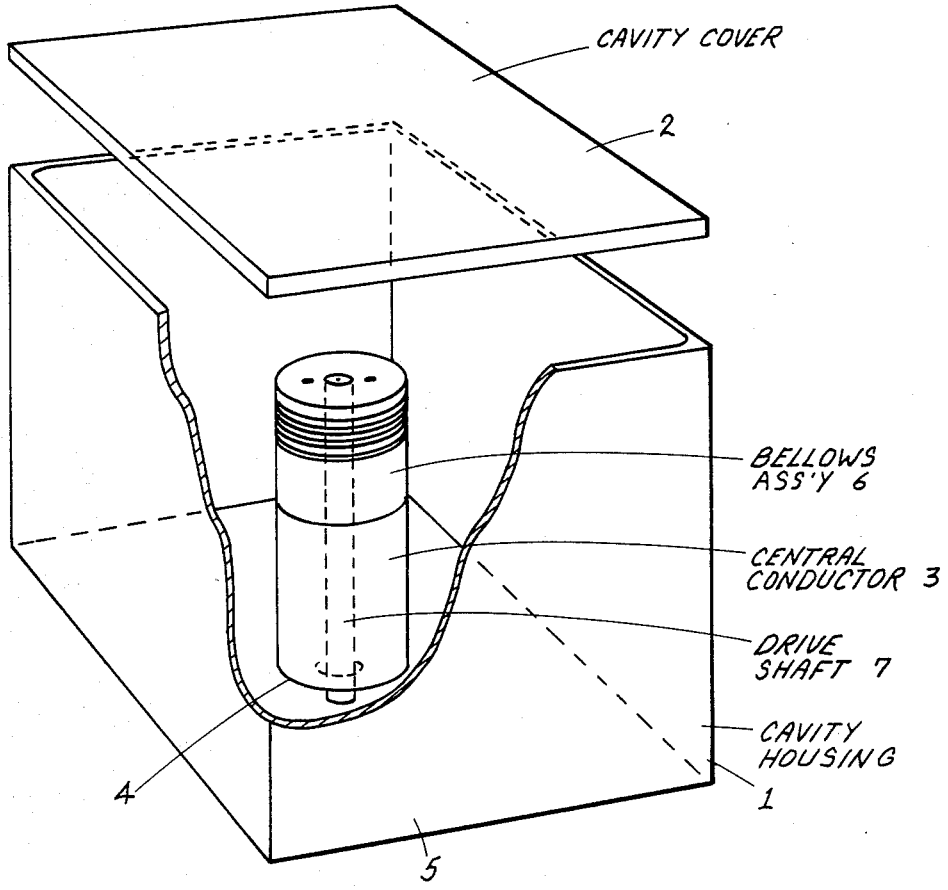
FIG. 1 is a perspective view partially exploded and partially cut away illustrating the microwave resonator in accordance with the principles of the present invention.

Referring to FIGS. 1–4, there is illustrated therein a microwave resonator having an adjustable resonant frequency in accordance with the principles of the present invention. The microwave resonant cavity includes a cavity housing 1 cut away and with its cover 2 moved away from its covering position to enable viewing the inner part of the cavity which includes a central conductor 3 having one end 4 fastened to the bottom 5 of cavity housing 1. Central conductor 3 extends toward the top wall or cover 2 of housing 1. The other end of the central conductor 3 spaced from the cover 2 includes thereon an integral adjustable bellows assembly 6 disposed coaxial of a longitudinal axis of the central conductor 3. A drive shaft 7, which is non-rotating but axially movable, is disposed coaxial of the longitudinal axis of and within the central conductor 3 with one end of the drive shaft 7 being fastened to the bellows assembly 6 and the other end of the drive shaft 7 being coupled to a drive means, such as drive shaft nut 8 (see FIG. 2) to cause axial movement of drive shaft 7, thereby adjusting the axial length of the bellows assembly 6 and, hence, the axial length of the central conductor 3 to adjust the resonant frequency of the resonant cavity.

As shown in FIG. 1, the housing 1 is rectangular and the central conductor 3 is cylindrical. The tuning principles disclosed herein could likewise be employed with other geometrical configurations of the resonant cavity. To provide temperature compensation so that the resonant frequency drift will be minimized due to temperature variation, the housing 1 and the central conductor 3 are made from a material, such as aluminum, having a first selected coefficient of thermal expansion and the drive shaft 7 is made from a material, such as invar, having a second selected coefficient of thermal expansion different than the first coefficient of thermal expansion with the first and second coefficients of thermal expansions being selected to minimize resonant frequency drift due to temperature variation.

With the bellows assembly 6 integrated into the microwave cavity resonator, there is provided frequency control of the cavity for compensation of fabrication inaccuracies and thermal expansion due to variations in temperature with a minimum disturbance of RF (radio frequency) fields and currents and, consequently, a minimum degregation of RF performance.

Figure 2:
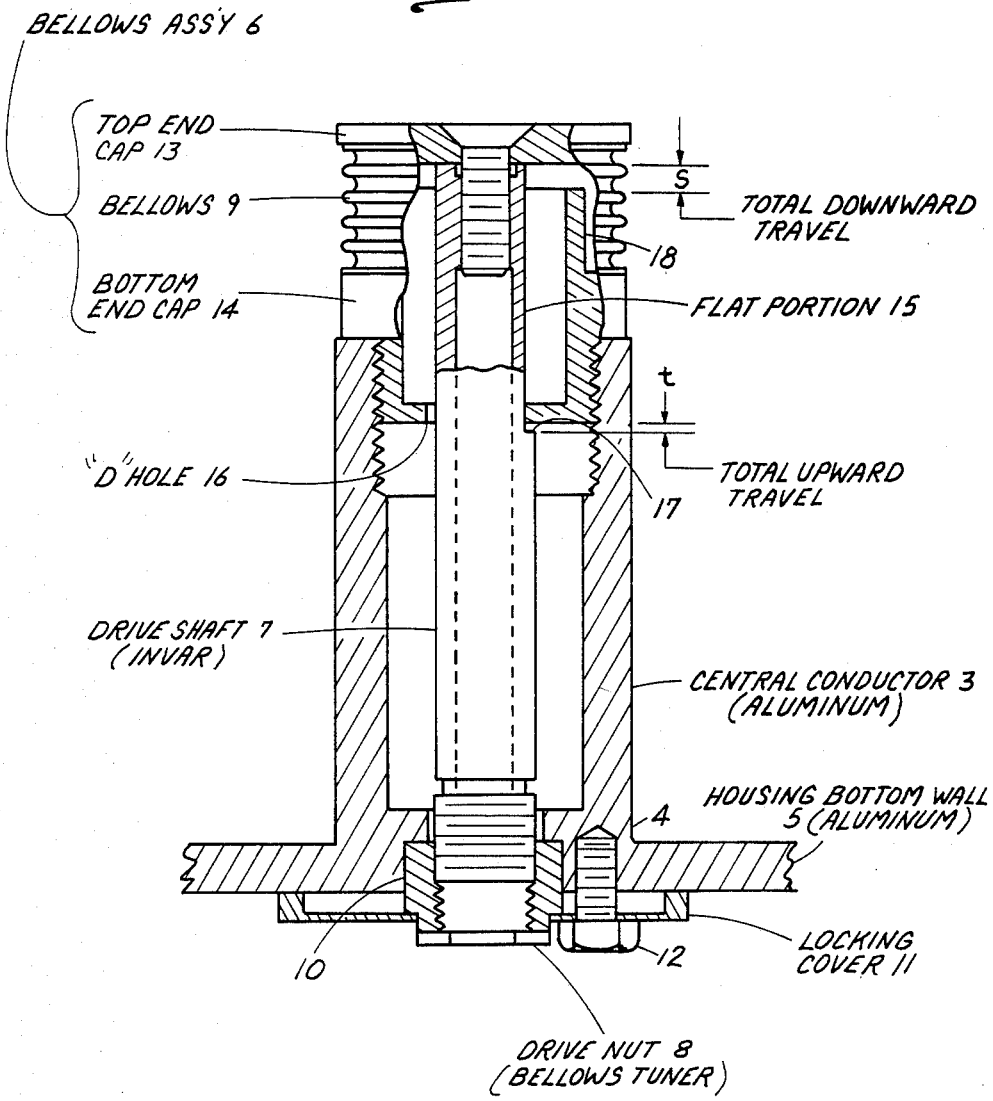
FIG. 2 is a longitudinal cross sectional view of the tunable center conductor assembly of the microwave resonator of FIG. 1.

As can be seen from FIGS. 1 and 2, the end portion of the central conductor 3 of the cavity has had added thereto a bellows assembly 6, a continuous wall spring. The drive shaft 7, disposed in the interior of central conductor 3, controls the length of the bellows 9 of the bellows assembly 6 and, therefore, the resonant length of the central conductor 3, which is normally the frequency determining element of the cavity by the relation $F=(V/4L,)$ where F is equal to frequency, V is equal to velocity of propagation and L is equal to the length of central conductor 3. A further advantage is that the bellows 9 is located at the free end of the central conductor 3, the open circuit end, where RF currents are weakest, which reduces the losses due to the interface of bellows 9 to central conductor 3, and also reduces the mechanical stress on the drive shaft 7.

As mentioned previously, the drive means is a drive shaft nut which is threaded on the end of drive shaft 7 and is placed in a recess 10 in the bottom wall 5 of housing 1. Rotation of the drive nut 8 causes axial movement of drive shaft 7. A locking cover 11 engages the drive nut 8 and is fastened to the outer surface of bottom wall 5 by bolts 12 to thereby lock drive nut 8 in position after the resonant frequency of the resonant cavity has been adjusted. The bellows assembly 6 includes the bellows 9 disposed between and fastened to the end of the drive shaft 7 remote from the bottom wall 5 and the bottom end cap 14 which, in the embodiment illustrated, is threaded into the inner surface of the central conductor 3. Drive shaft 7 has a flat portion 15 formed therein which engages the flat portion in a "D" hole 16 provided in the bottom end cap 14 through which drive shaft 7 passes. This engagement of the flat portion 15 and the "D" hole 16 prevents rotation of drive shaft 7 when moved axially by drive nut 8.

Flat portion 15 of drive shaft 7 provides a step 17 which in cooperation with bottom end cap 14 defines the total possible upper movement of drive shaft 7 and, hence, the maximum extension of bellows 9. The bottom end cap 14 has a portion 18 which surrounds drive shaft 7 and is disposed within bellows 9 which extends toward top end cap 13 but is spaced therefrom by amounts when in an unoperative position. The end of portion 18 cooperates with the bottom of top end cap 13 to define the total possible downward movement of drive shaft 7 and, hence, the maximum compression of bellows 9. The step 17 and the portion 18 in cooperation with the bottom end cap 14 and the bottom of top end cap 13 act to define the total tuning range of the bellows assembly 6.

From FIGS. 1 and 2, it can be seen that the physical length of drive shaft 7 determines the length of central conductor 3 and, therefore, the resonant frequency. By selection of the material of the drive shaft according to its coefficient of thermal expansion relative to the coefficient of thermal expansion of the central conductor 3 and the housing 1, the shift in resonant frequency due to temperature variations is controlled. This has the advantage of locating the temperature compensating material in a relatively small volume and completely outside of the RF region which significantly reduces weight, process control of materials, fabrication and assembly difficulties and eliminates plating requirements for electrical conductivity. In addition, the temperature compensation is continuous and automatic after initial tuning and locking of the drive shaft 7 and drive nut 8 by locking cover 11.

From FIG. 2, it can be seen that the flat portion 15, the step 17 and the portion 18 of bottom cap 14 limit the maximum and minimum extensions of the bellows 9, and prevents any turning motion or forces from acting on the bellows 9. Maximum compression of bellows 9 is controlled by the interior portion 18 of the bottom cap 14 which contacts the top end cap 13 under extreme compression after closing the compression gap s. Maximum extension of bellows 9 is controlled by step 17 contacting the bottom end cap 14 after closing the extension gap t. Turning of bellows 9 is prevented by the non-circular D-hole 16 in the bottom end cap 14 operating against the flat portion 15 of drive shaft 7 to prevent relative motion between the top and bottom end caps 13 and 14. The advantages of these mechanical controls is to prevent damage to the bellows 9 and to insure long operating life.

Figure 3:
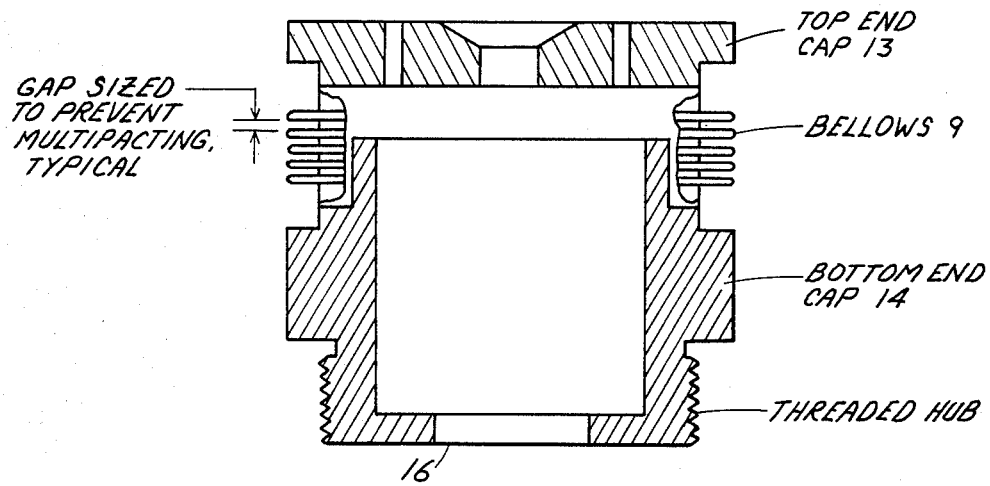
FIG. 3 is a cross sectional view of the bellows assembly of FIGS. 1 and 2.
Figure 4:
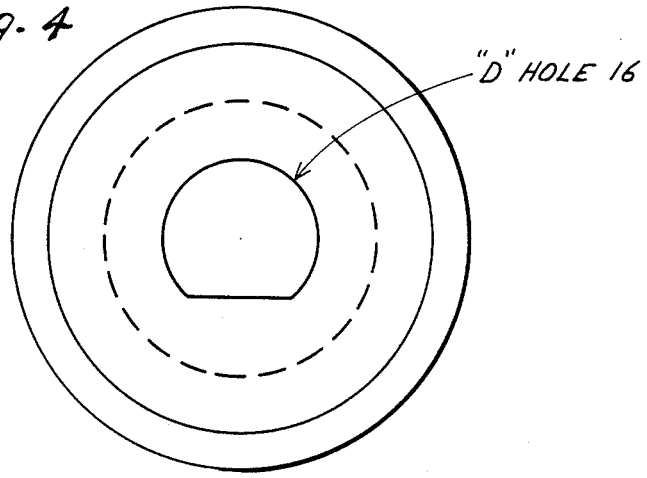
FIG. 4 is an end view of FIG. 3.

From FIG. 3, it can be seen that the pattern of grooves on the outside of the bellows 9 subject to RF fields is constructed for minimum gap widths in accordance with mulitpacting power versus frequency times electrode spacing (FD) curves. This has the advantage of preventing multipacting breakdown at medium power levels in vaccum applications.

While we have described above the principles of our invention in connection with specific apparatus, it is to be clearly understood that this description is made only by way of example and not as a limitation to the scope of our invention as set forth in the objects thereof and in the accompanying claims.

We claim:

1. A microwave resonator having an adjustable resonant frequency comprising:

an enclosed resonator housing;

a hollow central conductor having one end fastened to a bottom wall of said housing and extending toward a top wall of said housing, the other end of said central conductor being spaced from said top wall and including an adjustable bellows assembly disposed coaxial of a longitudinal axis of said central conductor; and a non-rotating, axially movable drive shaft disposed coaxial of said axis within said central conductor, one end of said drive shaft being fastened to said bellows assembly and the other end of said drive shaft being coupled to a drive means disposed in said bottom wall to cause axial movement of said drive shaft to adjust the axial length of said bellows assembly and, hence, the axial length of said central conductor to adjust said resonant frequency;

said drive means including a drive nut threaded onto said other end of said drive shaft and retained in a recess in the outer surface of said bottom wall, rotation of said drive nut axially moving said drive shaft.

2. A resonator according to claim 1, wherein said housing is rectangular, and said central conductor is cylindrical.

3. A resonator according to claim 2, wherein said housing and said central conductor are made from a material having a first selected coefficient of thermal expansion, and said drive shaft is made from a material having a second selected coefficient of thermal expansion different than said first coefficient of thermal expansion, said first and second coefficients of thermal expansion being selected to minimize resonant frequency drift due to temperature variation.

4. A resonator according to claim 3, wherein said housing and central conductor are made from aluminum, and said drive shaft is made from invar.

5. A resonator according to claim 2, wherein said bellows assembly includes a top end cap fastened to said one end of said drive shaft, a bottom end cap fastened to said central conductor adjacent said other end thereof, and a bellows disposed between and fastened to said top and bottom end caps, said drive shaft extending through said bottom end cap and said bellows.

6. A resonator according to claim 5, wherein
said drive shaft has a flat portion disposed thereon engaging a flat portion in an aperture in said bottom end cap through which said drive shaft extends to prevent rotation of said drive shaft when moved axially.

7. A resonator according to claim 6, wherein
said flat portion of said drive shaft provides a step which is in cooperation with said bottom end cap to define the total possible upward movement of said drive shaft and, hence, the maximum extension of said bellows.

8. A resonator according to claim 7, wherein
said bottom end cap includes a portion surrounding said drive shaft within said bellows extending toward said top end cap to define in cooperation with said top end cap the total possible downward movement of said drive shaft and, hence, the maximum compression of said bellows.

9. A resonator according to claim 1, further including
a locking cover disposed to engage said drive nut and to be fastened to the outer surface of said bottom wall to lock said drive nut in position after adjustment of said resonant frequency.

10. A resonator according to claim 9, wherein
said bellows assembly includes
a top end cap fastened to said one end of said drive shaft,
a bottom end cap fastened to said central conductor adjacent said other end thereof, and
a bellows disposed between and fastened to said top and bottom end caps,
said drive shaft extending through said bottom end cap and said bellows.

11. A resonator according to claim 10, wherein
said drive shaft has a flat portion disposed thereon engaging a flat portion in an aperture in said bottom end cap through which said drive shaft extends to prevent rotation of said drive shaft when moved axially.

12. A resonator according to claim 11, wherein
said flat portion of said drive shaft provides a step which is in cooperation with said bottom end cap to define the total possible upward movement of said drive shaft and, hence, the maximum extension of said bellows.

13. A resonator according to claim 12, wherein
said bottom end cap includes a portion surrounding said drive shaft within said bellows extending toward said top end cap to define in cooperation with said top end cap the total possible downward movement of said drive shaft and, hence, the maximum compression of said bellows.

14. A resonator according to claim 1, wherein
said housing and said central conductor are made from a material having a first selected coefficient of thermal expansion, and
said drive shaft is made from a material having a second selected coefficient of thermal expansion different than said first coefficient of thermal expansion, said first and second coefficients of thermal expansion being selected to minimize resonant frequency drift due to temperature variation.

15. A resonator according to claim 14, wherein
said housing and central conductor are made from aluminum, and said drive shaft is made from invar.

16. A resonator according to claim 14, wherein
said drive means includes a drive nut threaded onto said other end of said drive shaft and retained in a recess in the outer surface of said bottom wall, rotation of said drive nut axially moving said drive shaft.

17. A resonator according to claim 16, further including
a locking cover disposed to engage said drive nut and to be fastened to the outer surface of said bottom wall to lock said drive nut in position after adjustment of said resonant frequency.

18. A resonator according to claim 17, wherein
said bellows assembly includes
a top end cap fastened to said one end of said drive shaft,
a bottom end cap fastened to said central conductor adjacent said other end thereof, and
a bellows disposed between and fastened to said top and bottom end caps,
said drive shaft extending through said bottom end cap and said bellows.

19. A resonator according to claim 18, wherein
said drive shaft has a flat portion disposed thereon engaging a flat portion in an aperture in said bottom end cap through which said drive shaft extends to prevent rotation of said drive shaft when moved axially.

20. A resonator according to claim 19, wherein
said flat portion of said drive shaft provides a step which is in cooperation with said bottom end cap to define the total possible upward movement of said drive shaft and, hence, the maximum extension of said bellows.

21. A resonator according to claim 20, wherein
said bottom end cap includes a portion surrounding said drive shaft within said bellows extending toward said top end cap to define in cooperation with said top end cap the total possible downward movement of said drive shaft and, hence, the maximum compression of said bellows.

22. A resonator according to claim 1, wherein
said bellows assembly includes
a top end cap fastened to said one end of said drive shaft,
a bottom end cap fastened to said central conductor adjacent said other end thereof, and
a bellows disposed between and fastened to said top and bottom end caps,
said drive shaft extending through said bottom end cap and said bellows.

23. A resonator according to claim 22, wherein
said drive shaft has a flat portion disposed thereon engaging a flat portion in an aperture in said bottom end cap through which said drive shaft extends to prevent rotation of said drive shaft when moved axially.

24. A resonator according to claim 23, wherein
said flat portion of said drive shaft provides a step which is in cooperation with said bottom end cap to define the total possible upward movement of said drive shaft and, hence, the maximum extension of said bellows.

25. A resonator according to claim 24, wherein
said bottom end cap includes a portion surrounding said drive shaft within said bellows extending toward said top end cap to define in cooperation with said top end cap the total possible downward movement of said drive shaft and, hence, the maximum compression of said bellows.

26. A microwave resonator having an adjustable resonant frequency comprising:

an enclosed resonator housing;

a hollow central conductor having one end fastened to a bottom wall of said housing and extending toward a top wall of said housing, the other end of said central conductor being spaced from said top wall and including an adjustable bellows assembly disposed coaxial of a longitudinal axis of said central conductor; and a non-rotating, axially movable drive shaft disposed coaxial of said axis within said central conductor, one end of said drive shaft being fastened to said bellows assembly and the other end of said drive shaft being coupled to a drive means disposed in said bottom wall to cause axial movement of said drive shaft to adjust the axial length of said bellows assembly and, hence, the axial length of said central conductor to adjust said resonant frequency;

said bellows assembly including a top end cap fastened to said one end of said drive shaft, a bottom end cap fastened to said central conductor adjacent said other end thereof, and a bellows disposed between and fastened to said top and bottom end caps, said drive shaft extending through said bottom end cap and said bellows, said drive shaft being engaged by said bottom end cap to prevent rotation thereof.

27. A resonator according to claim 26, wherein said drive means includes a drive nut threaded onto said other end of said drive shaft and retained in a recess in the outer surface of said bottom wall, rotation of said drive nut axially moving said drive shaft.

28. A resonator according to claim 27, further including a locking cover disposed to engage said drive nut and to be fastened to the outer surface of said bottom wall to lock said drive nut in position after adjustment of said resonant frequency.

29. A resonator according to claim 26, wherein said drive shaft has a flat portion disposed thereon engaging a flat portion in a aperture in said bottom end cap through which said drive shaft extends to prevent rotation of said drive shaft when moved axially.

30. A resonator according to claim 29, wherein said flat portion of said drive shaft provides a step which is in cooperation with said bottom end cap to define the total possible upward movement of said drive shaft and, hence, the maximum extension of said bellows.

31. A resonator according to claim 30, wherein said bottom end cap includes a portion surrounding said drive shaft within said bellows extending toward said top end cap to define in cooperation with said top end cap the total possible downward movement of said drive shaft and, hence, the maximum compression of said bellows.

* * * * *